US007166340B1

(12) United States Patent
Clark

(10) Patent No.: US 7,166,340 B1
(45) Date of Patent: Jan. 23, 2007

(54) ARTIFICIAL TURF SYSTEM

(75) Inventor: Shannon Clark, Longview, TX (US)

(73) Assignee: A.R.M.S Building & Maintenance, Inc., Longview, TX (US)

( * ) Notice: Subject to any disclaimer, the term of this patent is extended or adjusted under 35 U.S.C. 154(b) by 0 days.

(21) Appl. No.: 11/187,312

(22) Filed: Jul. 22, 2005

(51) Int. Cl.
*A41G 1/00* (2006.01)

(52) U.S. Cl. ..... 428/17

(58) Field of Classification Search ..... 428/17, 428/25, 26, 542.6
See application file for complete search history.

(56) References Cited

U.S. PATENT DOCUMENTS

| | | | | |
|---|---|---|---|---|
| 5,212,842 | A | 5/1993 | Glydon | |
| 5,958,527 | A | 9/1999 | Prevost | |
| 6,338,885 | B1 | 1/2002 | Prevost | |
| 6,551,689 | B1 | 4/2003 | Prevost | |
| 6,689,447 | B1 | 2/2004 | Prevost | |
| 6,723,412 | B1 | 4/2004 | Prevost | |
| 6,746,752 | B1 | 6/2004 | Prevost | |
| 6,767,595 | B1 | 7/2004 | Prevost et al. | |
| 6,818,274 | B1 * | 11/2004 | Buck et al. | 428/87 |
| 6,877,932 | B1 | 4/2005 | Prevost | |
| 6,916,250 | B1 | 7/2005 | Ricigliano | |
| 2004/0214000 | A1 | 10/2004 | Huff et al. | |
| 2004/0247802 | A1 | 12/2004 | Reddick | |
| 2004/0253390 | A1 * | 12/2004 | Trafford | 428/17 |

* cited by examiner

*Primary Examiner*—Jennifer C. McNeil
*Assistant Examiner*—Gordon R. Baldwin
(74) *Attorney, Agent, or Firm*—Gary R. Jarosik

(57) ABSTRACT

An artificial turf system having a bottom layer comprised of a plurality of pads constructed from a cross-linked, closed cell, high-density foam, a top layer of synthetic fibers disposed upon the bottom layer to provide a synthetic grass surface, and an infill layer installed upon the top layer wherein the bottom layer functions to provide shock absorbing characteristics to the artificial turf system as well as to evacuate water laterally.

7 Claims, 2 Drawing Sheets

ARTIFICIAL TURF SYSTEM

BACKGROUND

In the art, various artificial turf systems are known. For example, U.S. Pat. No. 6,767,595 illustrates and describes an artificial turn system which includes an infill layer of particulate material that is evenly spread among rows of fiber yarns, i.e., synthetic grass, that extend upwardly from a backing mat which is disposed directly upon the underlying soil. The infill layer further includes a top covering sub-layer of non-marking material, such as recycled rubber used in the manufacture of soles for running shoes. The top covering sub-layer may be arranged to provide a checkered pattern of alternating color tones for improving the natural appearance of the synthetic surface.

Still further, U.S. Published Application No. 2004/0247802 illustrates and describes an artificial turf system which includes a support layer, a base layer, and an outer layer. The support layer comprises no more than compacted soil, crushed stone, crushed stone and sand, asphalt, concrete, or a combination thereof. Positioned over the support layer is a base layer which is a mat made up of a plurality of grids that are connected together. More particularly, each grid is formed of a plurality of interconnecting cells that comprise tubular members formed of semi-rigid or semi-flexible plastic, each tubular member having an upper portion with a first diameter and a lower portion having a second diameter. Disposed over the base layer is the outer layer comprised of synthetic fibers and infill. The lower portion of the tubular members are arranged to provide the overall system with vertical flexibility.

While artificial turf systems such as those illustrated and described in the aforementioned publications generally work for their intended purpose, what is needed is an artificial turf system having, among other things, improved durability, improved shock-absorbing characteristics, and improved drainage characteristics.

SUMMARY

In accordance with these and other needs, the following describes an artificial turf system having a bottom layer comprised of a plurality of pads constructed from a cross-linked, closed cell, high-density foam, a top layer of synthetic fibers disposed upon the bottom layer to provide a synthetic grass surface, and an infill layer installed upon the top layer wherein the bottom layer functions to provide shock absorbing characteristics to the artificial turf system as well as to evacuate water laterally.

A better understanding of the objects, advantages, features, properties and relationships of the artificial turf system will be obtained from the following detailed description and accompanying drawings which set forth illustrative embodiments which are indicative of the various ways in which the principles of the invention may be employed.

BRIEF DESCRIPTION OF THE DRAWINGS

For a better understanding of the artificial turn system, reference may be had to the following drawings in which.

DETAILED DESCRIPTION

Figure 1:
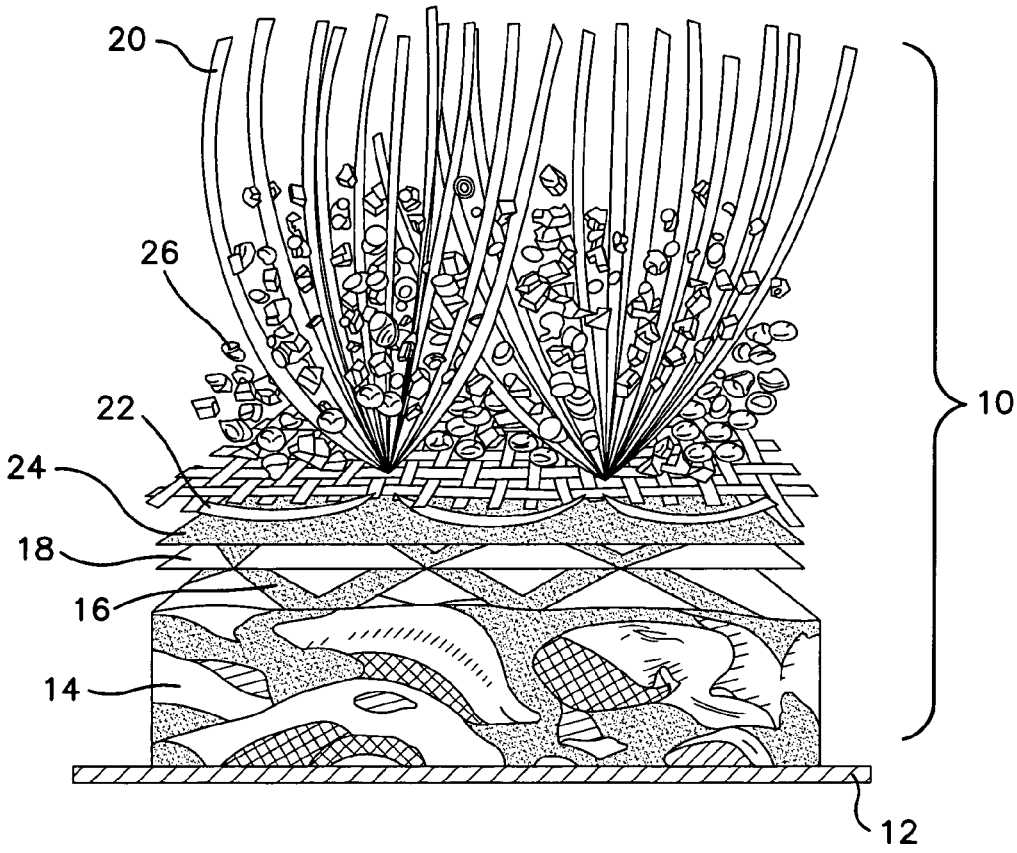
FIG. 1 is an exploded, cross-sectional view of an exemplary artificial turf system constructed in accord with the principles of the subject invention.
Figure 2:
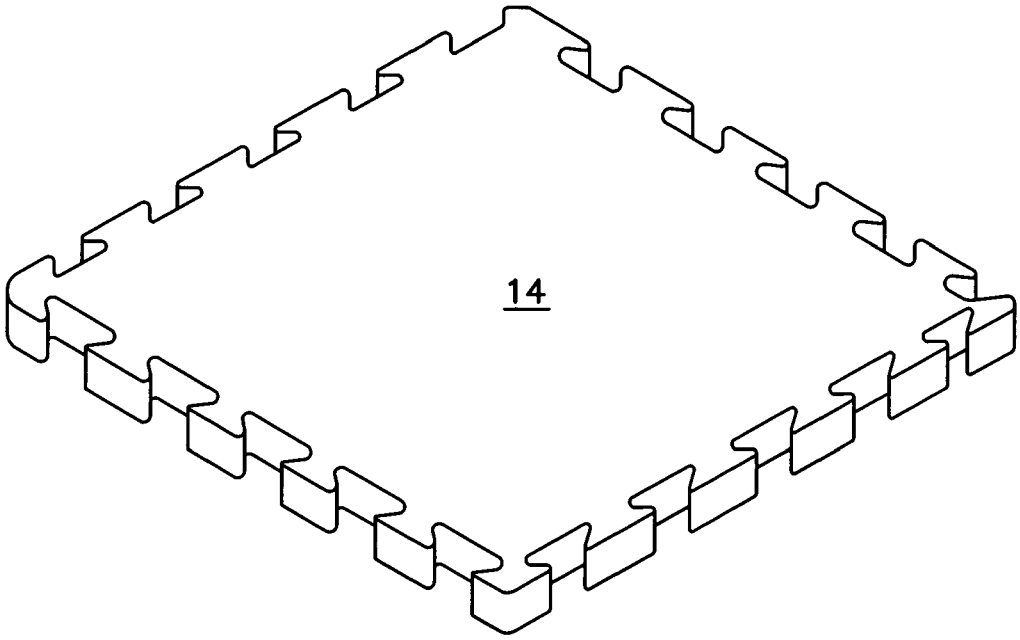
FIG. 2 is a view of an exemplary pad for use in the system of FIG. 1.

With reference to the FIG. 1, an exemplary artificial turf system is now described. Generally, the artificial turf system 10 is disposed upon a base layer 12 which is constructed from, for example, approximately ninety-five percent (95%) compacted and leveled soil and/or crushed stone using lime stabilization, cement stabilization or excavation and placement of select fill. Preferably, the base layer is provided with a grade away from the longitudinal center of the playing field to facilitate drainage. Accordingly, the base layer 12 may additionally include a drainage system, such as a French drain system, which would be positioned as close as possible to the periphery of the playing surface that includes the artificial turf system 10. The drains comprising the drainage system (which should have a diameter determined by expected flows resulting from rainfall data and the size of the artificial turn field) may be placed in trenches filled with permeable granular material and located at a depth that would be below any frost penetration.

Disposed above the base layer 12 are the multiple layers that comprise the artificial turf system 10. In this regard, the bottom layer 14 of the artificial turf system 10, which may be disposed directly upon the base layer 12, is comprised of a plurality of resilient pads. The bottom layer 14 is to be installed over the entire area that is to receive artificial turf. The pads that comprise the bottom layer 14 may be constructed using a cross-linked, closed cell high-density foam, e.g., a polyethylene material, having a thickness of approximately 0.8175 inches. Furthermore, the pads may include interlockable dovetail structures positioned around their periphery to allow adjacent pads to be placed into mating engagement with one another. The bottom layer 14 not only provides shock absorbing characteristics to the artificial turf system 10 but also functions to evacuate water laterally, i.e., towards the drainage system. Adhered to the top of the pads may be thin, e.g., 10 mil, reinforcing web mesh 16 that functions to provide further dimensional stability and durability to the system. Further adhered to the web mesh 16 may be a layer of a geotextile material 18 provided to filter debris from the water traveling towards the pads.

Carried upon the padding layers, i.e., bottom layer 14, web mesh layer 16, and geotextile material layer 18, are the layers which comprise the synthetic turf. In a preferred embodiment, the synthetic turf is one manufactured by Challenger Industries, Inc. of Dalton, Ga. and generally comprises monofilament yarns 20 stitched to a woven, mesh backing layer 22 which is, in turn, provided with a secondary backing layer 24. The secondary backing layer 24 may be a permeable, non-woven geotextile material or urethane or latex coated backing provided to bind or lock the yarn fibers 20 in place relative to the mesh backing layer 22. The mesh backing layer 22 may be a dimensionally stable, multi-layered, woven nylon mesh that the yarn fibers 20 are tufted into. The yarn fibers 20 are preferably two (2) inch long true 140 micron (or 100–210 micron) monofilament polyethylene fibers with a face weight of 42–60 oz. per square yard. The turf layers are preferably installed directly upon the padding layers without the use of an adhesive. Since the turf layers may be manufactured having a maximum width and length, adhesive may be used to join the sides of adjacent turf segments.

Finally, an infill layer 26 is provided. The infill layer 26, which is used to fill the voids between the fibers 20 to thereby allow the fibers to remain vertical and non-directional, may comprise a silicone dioxide, color coated sand having a size that meets needed sieve requirements. Preferably, the infill layer 26 is installed at approximately 5–7 pounds per square foot to a consistent depth to allow for approximately three-quarters of an inch of synthetic grass fibers 20 to be exposed above the infill layer 26.

To install the synthetic turf system 10, the base layer 12 is prepared and a liner may be installed over the base layer 12 with any seams being glued or heat welded to protect the base layer from any exposure to moisture. Thereafter, the padding layers 14, 16, 18 are installed with the pads being interlocked. The turf of choice is then installed upon the padding layer and the special turf filler is installed at a depth according to the pile height of the synthetic grass used.

While a specific embodiment of the invention has been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

All patents, patent applications, and other references cited within this document are hereby incorporated by reference in their entirety.

What is claimed is:

1. An artificial turf system, comprising:

a bottom layer comprised of a plurality of pads constructed from a cross-linked, closed cell, high-density foam;

a layer of reinforcing web meshing adhered to a top of the bottom layer;

a first layer of geotextile material disposed upon the layer of reinforcing web meshing;

a top layer of synthetic fibers disposed upon the first layer of geotextile material, the top layer providing a synthetic grass surface; and an infill layer installed upon the top layer, the infill layer being installed to a depth which allows the synthetic grass fibers to be exposed a predetermined length above the infill layer;

wherein the bottom layer functions to provide shock absorbing characteristics to the artificial turf system as well as to evacuate water laterally.

2. The artificial turf system as recited in claim 1, wherein the pads are constructed from a polyethylene material.

3. The artificial turf system as recited in claim 2, wherein the pads are interlocking.

4. The artificial turf system as recited in claim 3, wherein the bottom layer is disposed upon a compacted ground surface.

5. The artificial turf system as recited in claim 4, wherein the ground surface is approximately 95 percent compacted.

6. The artificial turf system as recited in claim 1, wherein the top layer comprises a woven, mesh backing layer to which the synthetic fibers are stitched.

7. The artificial turf system as recited in claim 6, wherein the top layer comprises a second layer of geotextile material to bind the synthetic fibers in place relative to the mesh backing layer.

* * * * *